US009613787B2

(12) United States Patent
Furuhashi et al.

(10) Patent No.: US 9,613,787 B2
(45) Date of Patent: Apr. 4, 2017

(54) TIME-OF-FLIGHT MASS SPECTROMETER FOR CONDUCTING HIGH RESOLUTION MASS ANALYSIS

(75) Inventors: Osamu Furuhashi, Uji (JP); Shinichi Yamaguchi, Kyoto (JP); Hideaki Izumi, Neyagawa (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/119,155

(22) PCT Filed: Sep. 16, 2008

(86) PCT No.: PCT/JP2008/002541
§ 371 (c)(1),
(2), (4) Date: Apr. 28, 2011

(87) PCT Pub. No.: WO2010/032276
PCT Pub. Date: Mar. 25, 2010

(65) Prior Publication Data
US 2011/0192972 A1 Aug. 11, 2011

(51) Int. Cl.
*H01J 49/00* (2006.01)
*H01J 49/04* (2006.01)
*H01J 49/40* (2006.01)

(52) U.S. Cl.
CPC ..... *H01J 49/0481* (2013.01); *H01J 49/0031* (2013.01); *H01J 49/408* (2013.01)

(58) Field of Classification Search
CPC .. H01J 49/00; H01J 49/02; H01J 49/40; H01J 49/401; H01J 49/403
(Continued)

(56) References Cited

U.S. PATENT DOCUMENTS 5,248,875 A * 9/1993 Douglas et al. ..... 250/282
6,207,954 B1 * 3/2001 Andrien et al. ..... 250/288
(Continued)

FOREIGN PATENT DOCUMENTS

JP 11-195398 7/1999
JP 2003-346704 12/2003
(Continued)

OTHER PUBLICATIONS

Wen Yu et al., Identification of the Facile Gas-Phase Cleavage of the Asp-Pro and Asp-Xxx Peptide Bonds in Matrix-Assisted Laser Desorption Time-of-Flight Mass Spectrometry, 1993, Anal. Chem, 65, 3015-3023.*
(Continued)

*Primary Examiner* — Jason McCormack
(74) *Attorney, Agent, or Firm* — Morgan, Lewis & Bockius LLP

(57) ABSTRACT

A first mass analysis is executed in a condition that gas is not introduced into a loop-flight chamber (4), and a time-of-flight spectrum obtained in a data processor (12) is stored in a storage unit (13). Next, a second mass analysis is executed on the same sample as the one used in the first mass analysis in a condition that a valve (8) is opened and helium gas (He) is introduced into the loop-flight chamber (4), and the time-of-flight spectrum is obtained in the data processor (12). If different kinds of ions having the same m/z value exit, these ions form a single peak in the first time-of-flight spectrum, while these ions appear as separate peaks in the second time-of-flight spectrum even though they have the same m/z value. This is because, in the second mass analysis, the ions collide with the gas and have different times of flight depending on their difference in size. A spectrum comparator (14) judges a change in the position or shape of the peak by comparing the two spectra, and outputs infor-
(Continued)

mation relating to the difference in the size of the ions (the molecular structure, charge state, or molecular class of the ions), and the like. Accordingly, a wider variety of information than ever before can be provided.

12 Claims, 2 Drawing Sheets

(58) Field of Classification Search
USPC ..... 250/281, 282, 287
See application file for complete search history.

(56) References Cited

U.S. PATENT DOCUMENTS

| | | | | |
|---|---|---|---|---|
| 7,800,055 | B2 * | 9/2010 | Geromanos et al. | 250/288 |
| 8,173,959 | B1 * | 5/2012 | Boumsellek et al. | 250/288 |
| 2001/0052569 | A1 * | 12/2001 | Bateman et al. | 250/288 |
| 2003/0222211 | A1 | 12/2003 | Okumura et al. | 250/287 |
| 2004/0188603 | A1 * | 9/2004 | Bateman et al. | 250/281 |
| 2004/0222369 | A1 * | 11/2004 | Makarov | H01J 49/004 250/281 |
| 2005/0045817 | A1 | 3/2005 | Yamaguchi et al. | 250/287 |
| 2005/0242281 | A1 * | 11/2005 | Li | 250/292 |
| 2005/0258364 | A1 * | 11/2005 | Whitehouse | H01J 49/42 250/292 |
| 2006/0138320 | A1 * | 6/2006 | Bateman | 250/288 |
| 2006/0163468 | A1 * | 7/2006 | Wells | H01J 49/4255 250/281 |
| 2006/0186330 | A1 * | 8/2006 | Zimmermann | G01N 27/622 250/287 |
| 2008/0149824 | A1 * | 6/2008 | Miller et al. | 250/287 |
| 2008/0156981 | A1 * | 7/2008 | Miller et al. | 250/287 |
| 2009/0179150 | A1 * | 7/2009 | Kovtoun | H01J 49/0081 250/283 |

FOREIGN PATENT DOCUMENTS

| | | | |
|---|---|---|---|
| JP | 2005-004988 | 1/2005 | |
| JP | 2005-079037 | 3/2005 | |
| WO | WO 2008047891 A2 * | 4/2008 | H01J 49/406 |

OTHER PUBLICATIONS

Yu et al., Identification of the Facile Gas-Phase Cleavage of the Asp-Pro and Asp-Xxx Peptide Bonds in Matrix-Assistated Laser Desorption Time-of-Flight Mass Spectrometry, 1993, Anal. Chem, 65, pp. 3015-3023.*

Yoon et al., Photo-Induced Dissociation of Protonated Peptide Ions in a Quadrupole Ion Trap Time-of-Flgith Mass Spectrometer, 2007, Bull. Korean Chem. Soc., vol. 28, No. 4.*

Yoon et al., Photo-Induced Dissociated of Protonated Peptide Ions in a Quadrupole Ion Trap Time-of-Flight Mass Spectrometer, 2007, Bill. Korean Chem. Soc., Vo. 28, No. 4.*

Yoon, Photo-Induced Dissociated of Protonated Peptide Ions in a Quadrupole Ion Trap Time-of-Flight Mass Spectrometer, 2007, Bull. Korean Chem. Soc., vol. 28, No. 4, pp. 619-623.*

Japanese language international preliminary report on patentability dated Apr. 19, 2011 and its English language translation for corresponding PCT application PCT/JP2008/002541.

* cited by examiner

TIME-OF-FLIGHT MASS SPECTROMETER FOR CONDUCTING HIGH RESOLUTION MASS ANALYSIS

CROSS-REFERENCE TO THE RELATED APPLICATIONS

This application is a national stage of international application No. PCT/JP2008/002541, filed on Sep. 16, 2008, the entire contents of which are incorporated herein by reference.

TECHNICAL FIELD

The present invention relates to a time-of-flight mass spectrometer.

BACKGROUND ART

Typically, in a time-of-flight mass spectrometer (TOFMS), the time required for an ion to fly through a certain distance is measured so as to calculate the mass of the ion (a m/z value, in the precise sense) from the time of flight, based on the fact that an ion accelerated by a certain amount of energy has a flight speed corresponding to the mass. Accordingly, an increase in the flight distance is particularly effective for an improvement of the mass resolving power. However, increasing the flight distance along a straight line is impractical because it inevitably leads to an increase in the size of the apparatus.

Accordingly, in order to increase the flight distance, a mass spectrometer called a multi-turn time-of-flight mass spectrometer has been developed (see Patent Documents 1 and 2, for example). In the multi-turn time-of-flight mass spectrometer, a closed loop orbit having the shape of a figure eight or an approximate circle is formed using two to four (or more) sector-shaped electric fields, and ions are made to repeatedly fly along the loop orbit multiple times, which effectively increases the flight distance of ions. In such a configuration, the flight distance is unconstrained by the size of the apparatus. As a result, the mass resolving power can be improved by increasing the number of turns of the ions.

In addition, like a reflectron-type TOFMS, such a multi-turn time-of-flight mass spectrometer can suppress a spread of the time-of-flight due to a spread (variation) of the energy that the ions have by using appropriate design of the electrodes forming the sector-shaped electric field such as the curvature or the shape so that the ions with a larger energy will fly along an outer orbit than the center orbit, i.e., the orbit having a longer distance. Therefore, an influence of the initial energy variation when the ions are accelerated can be diminished and the mass resolving power can be further improved.

Patent Document 1: JP-A H11-195398
Patent Document 2: JP-A 2005-79037

DISCLOSURE OF THE INVENTION

Problem to be Solved by the Invention

However, conventional time-of-fight mass spectrometers are adapted to separate ions according to their m/z values. Accordingly, it is not possible to separate a nitrogen molecular dication ($^{14}N_2^{2+}$) from a nitrogen atomic ion ($^{14}N^+$).

The present invention has been made in view of the previously described problems. An object of the present invention is to provide a time-of-flight mass spectrometer capable of separating various kinds of ions with high mass resolving power, as well as separating various kinds of ions that cannot be separated according to their m/z value, thereby collecting more detailed information than ever before.

Means for Solving the Problems

According to the present invention made to solve the previously described problems, a time-of-flight mass spectrometer conducting a mass analysis by providing a predetermined amount of kinetic energy to an ion to make the ion fly in a flight space, comprises:

a) a gas introduction means for introducing predetermined gas into at least a part of a flight path of the ion, b) an analysis execution control means for executing a mass analysis on a same sample both in a condition that the gas is not introduced by the gas introduction means and in a condition that the gas is introduced, respectively, and obtaining respective time-of-flight spectra from each mass analysis executed in the two conditions, and c) an ion identification means for identifying each ion among various kinds of ions having a same m/z value by making a comparison on at least one of a position, shape, or strength of peaks appearing on two time-of-flight spectra obtained under the control of the analysis execution control means.

In the time-of-flight mass spectrometer according to the present invention, when ions pass through a region into which gas is introduced by the gas introduction means, the ions collide with the gas with a predetermined probability. Accordingly, a portion of the kinetic energy of the ions is lost, causing the flight speed of the ions to be decreased. Typically, the probability of the collision of an ion with gas depends on the size of the ion. The larger the size of the ion is, the more frequently the ion collides with the gas, exhibiting a significant loss of the kinetic energy. Accordingly, even if there are different kinds of ions having the same m/z value, a difference occurs in the time-of-flight of these ions if they differ from each other in size, structure (shape), molecular class (classes of molecules, such as lipids or peptides), or charge state.

Therefore, the analysis execution control means executes a mass analysis on the same sample under respective conditions that the predetermined gas is not introduced (typically, in a high vacuum) and that the predetermined gas is introduced, so as to obtain respective time-of-flight spectrums under those conditions. In the time-of-flight spectrum obtained by the mass analysis performed in the high vacuum, any ions having the same m/z value appear as one peak even if they are different kinds of ions. On the other hand, in the time-of-flight spectrum obtained by the mass analysis performed in the condition that gas is introduced, the difference among the kinds of ions, i.e., the difference in the size or the configuration of the ions, causes a difference in the time of flight even if the ions have the same m/z value. As a result, the peak is separated into two, or even if the peak is not clearly separated, the shape of the peak is deformed or the peak strength is varied. The ion identification means judges whether or not different kinds of ions having the same m/z value exist by making comparison on the position, shape, or strength of the corresponding peaks on the two time-of-flight spectra.

For example, in the case where the peak is separated into two peaks on the time-of-flight spectrum in the condition that gas is introduced, it can be judged that the ion having the longer time-of-flight is the larger ion. In addition, if ions are not lost due to the collision with gas (or if the loss of the ions is negligible), the peak appearing on the time-of-flight spectrum in the condition that gas is introduced represents the amount of the respective ions, thereby enabling the quantitative determination of the ions.

A preferable embodiment of the time-of-flight mass spectrometer according to the present invention is a mass spectrometer wherein a multi-turn time-of-flight configuration for making ions to repeatedly fly in a same flight path is adopted.

In the multi-turn time-of-flight mass spectrometer, ions repeatedly pass through the region where gas is introduced. Therefore, even in the case where the amount of gas introduced in the flight path is comparatively small, and thus, a sufficiently large difference in the time-of-flights does not occur with a single passage of the ions, a large difference in the time of flight eventually occurs. This causes a remarkable change in the position or shape of the peak on the time-of-flight spectrum. Accordingly, the judgment on whether or not different kinds of ions exist can be easily and more correctly made.

Typically, when a flying ion with a certain amount of kinetic energy collides with gas, the ion is easily dissociated due to the collision induced dissociation. Accordingly, in the time-of-flight mass spectrometer according to the present invention, it is preferable that the mass analysis is executed in a state that gas is introduced under a condition that the dissociation is least likely to occur. One of the effective methods is to use the lightest possible gas as the predetermined gas. As a preferable example, helium gas may be used, which is the lightest inert gas.

The use of such a light gas is effective not only for making the dissociation of the ions less likely to occur, but also for suppressing the loss of ions during their flight since ions barely run off the flight path upon collision with the gas. Of course, in order to make the dissociation of the ions less likely to occur, the amount of introduced gas may be reduced (in other words, the gas pressure may be kept at low levels). However, as previously described, using only a small amount of gas reduces the effect of causing the difference in the time-of-flight depending on the size of the ions. In such a case, it is preferable to adopt a multi-turn time-of-flight configuration.

Furthermore, a reduction in the initial kinetic energy provided to ions when introducing the ions into the flight space is also effective for avoiding the dissociation of the ions due to the collision induced dissociation. However, if the initial kinetic energy is too low, the ions which gradually lose their kinetic energy on the way cannot arrive at the detector. Accordingly, it is necessary to give ions at least a certain amount of initial kinetic energy, based on the length of the flight path (the number of turns for the multi-turn time-of-flight mass spectrometer, for example), the gas pressure, and the like.

Effect of the Invention

Utilizing the time-of-flight mass spectrometer according to the present invention, the m/z value of an ion derived from a component in a sample can be measured with high mass resolving power by a normal mass analysis. When there are different kinds of ions having the same (or approximately same) m/z value and yet different sizes, configurations, or molecular classes, the present device can provide information at least relating to their existence. Furthermore, in the time-of-flight mass spectrometer according to the present invention, the separation and detection of ions according to the difference in their m/z value, and the separation and detection of ions having the same m/z value depending on their size, configuration, or molecular class can be conducted using a single apparatus with simple operations. Accordingly, helpful information for revealing the molecular structure of an ion can be efficiently collected.

EXPLANATION OF NUMERALS

1 . . . Ion Source
2 . . . Loop Orbit
3 . . . Sector-Shaped Electrode Pair
4 . . . Loop-Flight Chamber
5 . . . Detector
6 . . . Vacuum Chamber
7 . . . Gas Source
8 . . . Valve
9 . . . Voltage Application Unit
10 . . . Controller
11 . . . A/D Converter
12 . . . Data Processor
13 . . . Spectrum Storage Unit
14 . . . Spectrum Comparator
15 . . . Output Unit

BEST MODE FOR CARRYING OUT THE INVENTION

Figure 1:
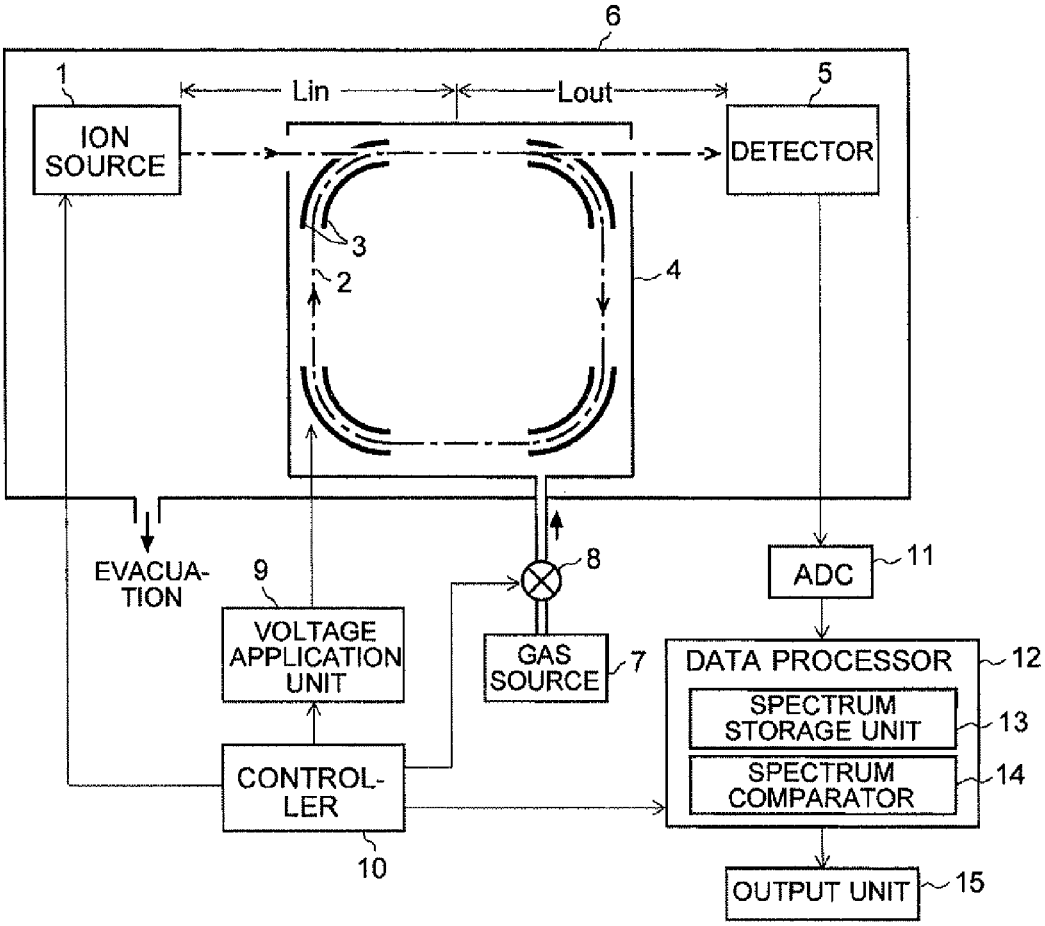
FIG. 1 is a schematic configuration diagram showing a multi-turn time-of-flight mass spectrometer according to an embodiment of the present invention.

A multi-turn time-of-flight mass spectrometer according to an embodiment of the present invention is described with reference to the attached drawings. FIG. 1 is a schematic configuration diagram showing the multi-turn time-of-flight mass spectrometer according to the present embodiment.

In a vacuum chamber 6 evacuated by a non-illustrated vacuum pump, an ion source 1, a loop-flight chamber 4, and a detector 5 are disposed. Inside the loop-flight chamber 4, a plurality of sector-shaped electrode pairs 3 which define a loop orbit 2 are arranged. Into the loop-flight chamber 4, predetermined gas is supplied at a predetermined pressure from a gas source 7 at a time when a valve 8 is opened. The valve 8, the sector-shaped electrode pairs 3 and a voltage application unit 9 for applying a predetermined voltage to the ion source 1 are controlled by a controller 10. A detection signal detected by the detector 5 is converted by an A/D converter 11 to digital data at a predetermined sampling time interval, and the obtained data is processed by a data processor 12. The data processor 12 includes a spectrum storage unit 13 and a spectrum comparator 14 as functional blocks which are characteristic of the present embodiment, and the result of the processing is output from an output unit 15. As the predetermined gas prepared in the gas source 7, light inert gas is preferable for reasons which will be described later. Helium gas is used in the present embodiment.

In the ion source 1, a sample molecule is ionized. The generated various kinds of ions are provided with predetermined initial energy and begin flying. It should be noted that, like a three-dimensional quadrupole ion trap or similar device, the ion source 1 may temporarily retain various kinds of ions generated in an outside area and concurrently provide energy to these ions at a predetermined timing so as to make the ions begin flying.

The ions which begin flying from the ion source 1 serving as a starting point enter the loop-flight chamber 4 and are placed on the loop orbit 2 created by the effect of a plurality of sector-shaped electric fields respectively formed between the electrodes of a plurality of sector-shaped electrode pairs 3. The shape of the loop orbit 2 is not limited to the one illustrated in FIG. 1, but various shapes including an approximately elliptical shape and a figure eight are realizable. The ions are made to leave the loop orbit 2 after flying through the loop orbit 2 once or a plurality of times. The ions exit from the loop-flight chamber 4, and arrive at and detected by the detector 5 disposed outside of the loop-flight chamber 4. The various kinds of ions are provided with the same amount of kinetic energy and begin flying. This means that an ion having a smaller m/z value flies at a higher speed. For this reason, the ion having the smaller m/z value arrives at the detector 5 earlier. The larger the m/z value of an ion is, the later the ion arrives at the detector 5.

In a condition that the valve 8 is closed so as to prevent helium gas from being introduced into the loop-flight chamber 4, an analysis operation is executed in the same manner as in the case of a conventionally known multi-turn time-of-flight mass spectrometer. Specifically, a flight distance Lto1 from a point where a certain ion departs from the ion source 1 to a point where the ion arrives at the detector 5 is:

$$Lto1 = n \cdot L + Lin + Lout$$

where n is the number of turn of the ion in the loop orbit 2, L is the circumferential length of the loop orbit, Lin is the length of an entrance path, and Lout is the length of an exit path, as shown in FIG. 1. As the flight distance becomes longer, in other words, as the number of turns n increases, the mass resolving power is further improved.

Figure 2:
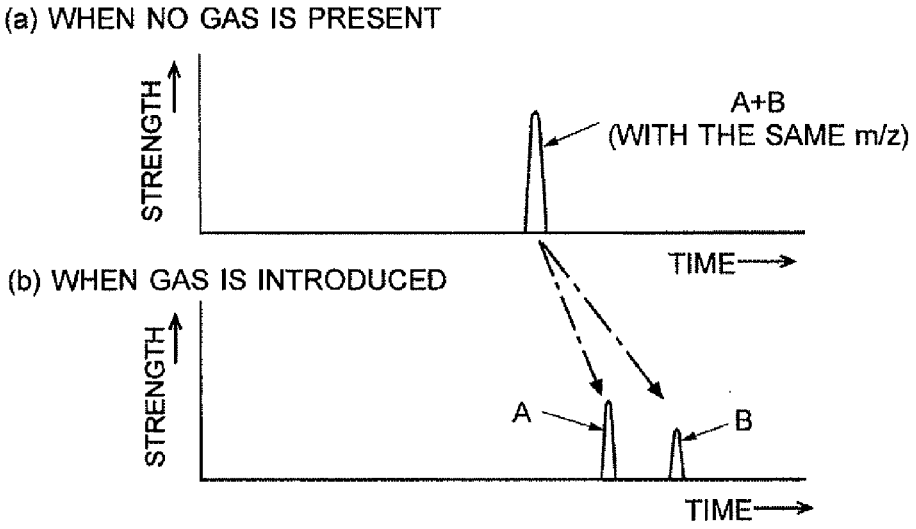
FIG. 2 is an explanatory diagram showing an analysis operation in the multi-turn time-of-flight mass spectrometer according to the present embodiment.

Next, the analysis operation characteristic of the multi-turn time-of-flight mass spectrometer according to the present embodiment is described with reference to FIGS. 2 and 3.

As previously described, the controller 10 executes a first mass analysis on a sample in a condition that the valve 8 is closed, and a time-of-flight spectrum is obtained in the data processor 12. Here, for simplicity of the description, the case is considered where a single peak is obtained on the time-of-flight spectrum, which is shown in FIG. 2(*a*). Since the time-of-flight can be uniquely converted into the m/z value, when a mass spectrum is calculated from the time-of-flight spectrum shown in FIG. 2(*a*), one peak also appears on the mass spectrum. This is the peak due to a packet of ions having the m/z values that can be considered identical within a margin of error in the mass resolving power. In the conventional multi-turn time-of-flight mass spectrometer, the analysis is terminated at this point, after which the obtained mass spectrum is immediately analyzed and processed.

On the other hand, in the multi-turn time-of-flight mass spectrometer according to the present embodiment, the time-of-flight spectrum obtained in the previously described first mass analysis is stored in the spectrum storage unit 13. Subsequently, the controller 10 opens the valve 8 to introduce helium gas into the loop-flight chamber 4 so that the inside of the loop-flight chamber 4 is kept at a predetermined gas pressure. Under this condition, a second mass analysis with respect to the sample identical to the one in the first mass analysis is implemented and the time-of-flight spectrum is again obtained in the data processor 12. The analysis conditions are made to be the same as those in the first mass analysis except for introducing helium gas in the loop-flight chamber 4 to keep the inside thereof at the predetermined gas pressure.

For Example, though a nitrogen molecular dication ($^{14}N_2^{2+}$) and a nitrogen atomic ion ($^{14}N^+$) are different kinds of ions from each other, they have the same m/z value. For this reason, they form the same single peak on the time-of-flight spectrum obtained in the previously described first analysis. It does not appear that the peak derives from plural kinds of ions. On the other hand, in the second mass analysis executed under the condition that helium gas is introduced into the loop-flight chamber 4 at an appropriate gas pressure, even such ions that have the same m/z value will have different times of flight if their sizes are different from each other.

Figure 3:
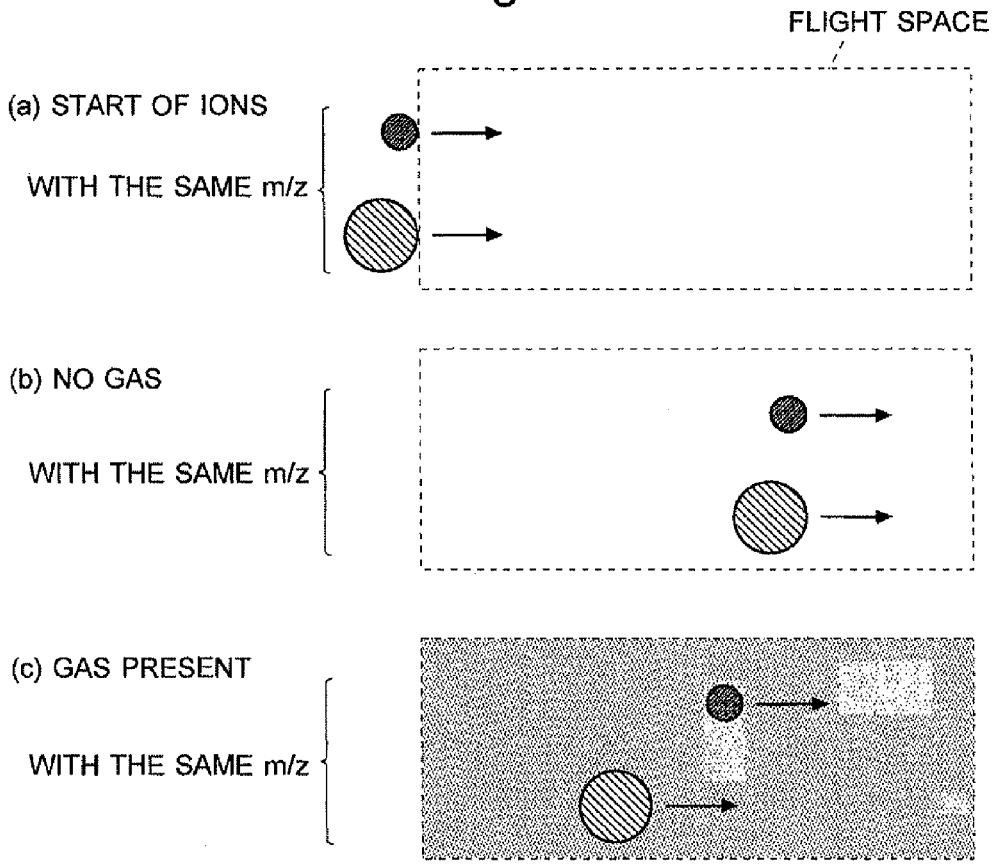
FIG. 3 is the explanatory diagram showing the analysis operation in the multi-turn time-of-flight mass spectrometer according to the present embodiment.

Now, consideration is given to the case where two kinds of ions having the same m/z value but different sizes are provided with the same kinetic energy and simultaneously introduced into a flight space, as shown in FIG. 3(*a*). When no gas exists in the flight space (i.e., when the space is in vacuum), the flight speed of the ions depends on the m/z value. Accordingly, no difference occurs in the time-of-flight (see FIG. 3(*b*)), and the two kinds of ions should arrive at the detector at the same time. In contrast, if helium gas exists in the flight space, the ions collide with the gas in the flight space and gradually lose kinetic energy. Accordingly, the flight speed of the ions slows down, i.e., the ions decelerate. The larger the size of an ion is, the larger the degree of deceleration is, since the larger ion has more opportunities to collide with gas. Therefore, as shown in FIG. 3(*c*), the difference occurs in the time-of-flight depending on the size of ions, and the ions respectively arrive at the detector at different points in time.

Figure 4:
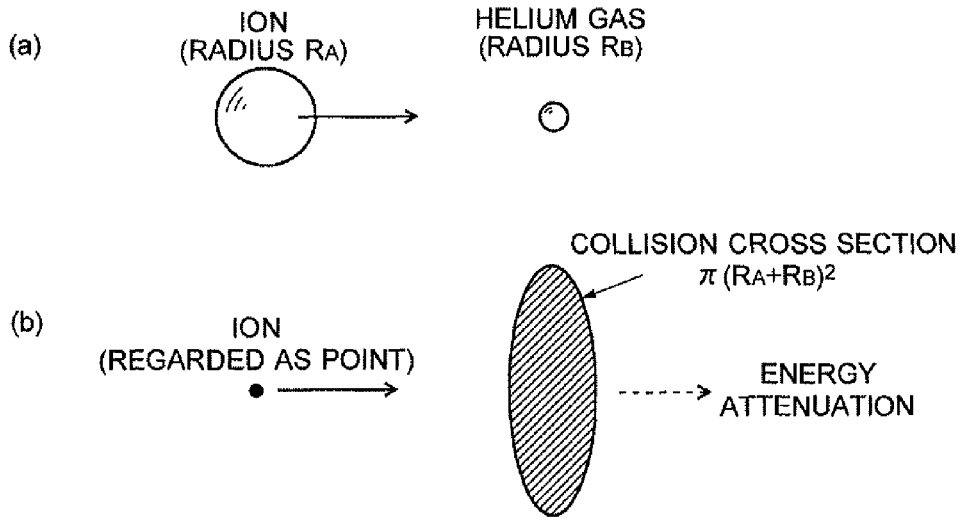
FIG. 4 is a schematic explanatory diagram showing an energy attenuation due to a collision of ions with gas.

The collision of ions with gas can be recognized as a collision between spherical objects, i.e., between an ion having a radius of $R_A$ and gas having a radius of $R_B$, as shown in FIG. 4(*a*). This case can be considered using a further abstracted model as shown in FIG. 4(*b*). Specifically, this model regards an ion as a tiny point having an infinitely small radius, in which case the collision of the ion with the gas occurs when this tiny point passes through a circular region having a radius of $R_A+R_B$. The cross section of the circular region is called a collision cross section and given by $\pi (R_A+R_B)^2$. When the point representing the ion passes through this region, the ion loses a portion of its kinetic energy due to an interaction with the gas (such as an attracting force or a repulsive force). On the other hand, when the ion bypasses the region, the ion does not undergo mutual interaction with the gas, and thus, the kinetic energy of the ion is maintained as it is. The collision cross section can be considered as an apparent size of the gas, viewed from the ion. The collision cross section for an ion practically depends on the molecular structure (shape) or charge state of the ion or the type of a functional group added on the ion, in addition to the size of the ion.

As previously described, even if there are different kinds of ions having the same m/z value, these ions will have different times of flight if they differ from each other in size (or in any of the aforementioned factors that influence the collision cross section). Therefore, on the time-of-flight spectrum obtained by the second mass analysis, two peaks originating from the same m/z value separately appear as shown in FIG. 2(*b*). It can be assumed that component A, which appears earlier than component B, has, for example, a smaller size of ion than that of the component B which appears later. Accordingly, the spectrum comparator 14 compares a time-of-flight spectrum obtained in the first mass analysis with a time-of-flight spectrum obtained in the second mass analysis; specifically, the comparison is made in terms of the position, shape, strength or other properties of the peaks which appear on the respective time-of-flight spectra. In this example, since it is obvious that one peak is separated into two peaks, the judgment can be made that there are two kinds of ions that differ from each other in size, molecular structure, charge state, molecular class, and so on. The result of the judgment is outputted from the output unit 15.

Furthermore, information relating to the quantities or molecular structures of a plurality of components can be obtained by analyzing the strength or temporal difference of the peaks separated in the spectrum comparator 14. It is possible to conduct the analysis for various materials contained in a sample more minutely and accurately by using the information and the mass spectrum obtained by the usual mass analysis (i.e., the first mass analysis).

When a flying ion collides with gas, the ion may undergo collision induced dissociation under some conditions, to be divided into smaller fragments. If dissociation occurs, a discrimination of each ion among the different kinds of ions having the same m/z value becomes difficult. Therefore, it is preferable to perform the second mass analysis under a condition that makes the dissociation least likely to occur.

With respect to the collision induced dissociation in which an ion having a kinetic energy collides with gas, it can be said that the heavier the gas is, the more likely it is to cause the collision induced dissociation. For this reason, helium gas, which is the lightest inert gas, is used to avoid collision induced dissociation in the previously described embodiment. Furthermore, if heavier gas, such as xenon, is introduced into the loop-flight chamber 4, the collision of an ion with gas can make a strong impact on the ion, causing the ion to significantly change its flight path, if not dissociated. It increases the possibility of the ion to run off the loop orbit 2. In contrast, the use of light gas prevents the collided ion from running off the loop orbit 2, advantageously reducing the loss of the ions during their flight.

Another possible method for making the collision induced dissociation harder to occur is to reduce the amount of gas introduced into the loop-flight chamber 4. However, it requires a certain degree of amount of gas to be introduced into the loop-flight chamber 4 in order to cause the previously described difference in the time of flight to occur depending on the size of the ions. Accordingly, it is preferable to conduct a preliminary experiment to determine an appropriate gas pressure in the loop-flight chamber 4 at which the change in the positions or shapes of the peaks originating from the ions having different sizes can appear clearly and the problem of dissociation does not arise. The supplied amount of gas may be controlled in such a manner that the practical gas pressure in the loop-flight chamber 4 is maintained at the experimentally determined gas pressure.

Still another method for making the collision induced dissociation harder to occur is to reduce the initial kinetic energy given to the ions released from the ion source 1. This will suppress the collision energy generated at a time when the ions collide with gas. However, if the initial kinetic energy is extremely reduced, the loss of ions during their flight increases. Furthermore, the time of flight is totally increased, elongating a time period required for the analysis. The increase in the number of turns could also cause some ions to lose their ability to fly on the way. Therefore, the present case also needs a preliminary experiment for determining the appropriate initial kinetic energy in advance.

Although helium gas is introduced into the whole loop orbit 2 in the previous embodiment, it is possible, in principle, to introduce the gas into a limited part of the flight path of the ions. However, introducing the gas into the longest possible section of the flight path is advantageous in that the effect of the deceleration of the ions will be sufficiently obtained even if the amount of the introduced gas is small. This results in a noticeable change in the position or shape of the peak as shown in FIG. 2(*b*).

Furthermore, the time-of-flight mass spectrometer according to the present invention can be applied not only to a multi-turn time-of-flight type mass spectrometer according to the previously described embodiment, but also to other types of time-of-flight mass spectrometers having various flight paths, including a linear-type flight path or a reflectron-type flight path. However, as it is clear in the previous description, it is preferable that the flight path into which gas is introduced is made to be as long as possible. In this point, the multi-turn time-of-flight type configuration is preferable. The term "multi-turn time-of-flight type" does not always mean that ions repeatedly fly in a closed orbit; it also includes a system that makes ions repeatedly reciprocate in a linear or curved orbit.

Furthermore, it is clear that an appropriate change, modification, or addition within the range of the subject matter of the present invention is included in the scope of the claims of the present application.

The invention claimed is:

1. A time-of-flight mass spectrometer conducting a mass analysis by providing a predetermined amount of kinetic energy to an ion to make the ion fly in a flight space, comprising:

a flight chamber having the flight space in which an ion having a smaller mass-to-charge ratio flies at a higher speed than an ion having a larger mass-to-charge ratio, and a flight time required for an ion to fly through the flight space is measured and a mass-to-charge ratio of the ion is determined based on the flight time;

a gas introduction member for introducing predetermined gas into at least a part of the flight space where ions are separated according to their flight time both in a condition that the gas is not introduced and in a condition that the gas is introduced;

a control member for executing a mass analysis on a same sample both in a condition that the gas is not introduced and in a condition that the gas is introduced by the gas introduction member, respectively, and obtaining respective time-of-flight spectra from each mass analysis executed in the two conditions; and an ion identification member for identifying each ion among various kinds of ions having a same m/z value by making a comparison on at least one of a position, shape, or strength of peaks appearing in two time-of-flight spectra obtained under the control of the control member.

2. The time-of-flight mass spectrometer according to claim 1, wherein a multi-turn time-of-flight configuration for making ions to repeatedly fly in a same flight path is adopted.

3. The time-of-flight mass spectrometer according to claim 1, wherein the predetermined gas is helium gas.

4. The time-of-flight mass spectrometer according to claim 2, wherein the predetermined gas is helium gas.

5. A time-of-flight mass spectrometer conducting a mass analysis by providing a predetermined amount of kinetic energy to an ion to make the ion fly in a flight space, comprising:

an ion source;

a flight chamber coupled to the ion source, wherein the flight chamber has the flight space such that an ion having a smaller mass-to-charge ratio flies at a higher speed than an ion having a larger mass-to-charge ratio, and a flight time required for an ion to fly through the flight space is measured and a mass-to-charge ratio of the ion is determined based on the flight time;

a gas introduction member for introducing predetermined gas into at least a part of the flight space where ions are separated according to their flight time both in a condition that the gas is not introduced and in a condition that the gas is introduced;

a control member for executing a mass analysis on a same sample both in a condition that the gas is not introduced by the gas introduction means and in a condition that the gas is introduced, respectively, and obtaining respective time-of-flight spectra from each mass analysis executed in the two conditions; and an ion identification member for identifying each ion among various kinds of ions having a same m/z value by making a comparison on at least one of a position, shape, or strength of peaks appearing in two time-of-flight spectra obtained under the control of the analysis execution control means.

6. The time-of-flight mass spectrometer according to claim 5, wherein the flight chamber includes a multi-turn time-of-flight configuration for making ions fly repeatedly in a same flight path.

7. The time-of-flight mass spectrometer according to claim 5, wherein the predetermined gas is helium gas.

8. The time-of-flight mass spectrometer according to claim 6, wherein the predetermined gas is helium gas.

9. A time-of-flight mass spectrometer conducting a mass analysis by providing a predetermined amount of kinetic energy to an ion to make the ion fly in a flight space, comprising:

a loop-flight chamber;

a gas introduction member for introducing predetermined gas into at least a part of the loop-flight chamber where ions are separated according to their flight speeds both in a condition that the gas is not introduced and in a condition that the gas is introduced;

a control member for executing a mass analysis on a same sample both in a condition that the gas is not introduced by the gas introduction means and in a condition that the gas is introduced, respectively, and obtaining respective time-of-flight spectra from each mass analysis executed in the two conditions; and an ion identification member for identifying each ion among various kinds of ions having a same m/z value by making a comparison on at least one of a position, shape, or strength of peaks appearing in two time-of-flight spectra obtained under the control of the analysis execution control means.

10. The time-of-flight mass spectrometer according to claim 9, wherein the loop-flight chamber includes a multi-turn time-of-flight configuration for making ions fly repeatedly in a same flight path.

11. The time-of-flight mass spectrometer according to claim 9, wherein the predetermined gas is helium gas.

12. The time-of-flight mass spectrometer according to claim 10, wherein the predetermined gas is helium gas.

* * * * *